US011761683B2

(12) United States Patent
Lim et al.

(10) Patent No.: US 11,761,683 B2
(45) Date of Patent: Sep. 19, 2023

(54) LINEAR COMPRESSOR

(71) Applicant: LG Electronics Inc., Seoul (KR)

(72) Inventors: Jaeyoun Lim, Seoul (KR); Jungwan Heo, Seoul (KR); Youngcheol Han, Seoul (KR)

(73) Assignee: LG Electronics Inc., Seoul (KR)

( * ) Notice: Subject to any disclaimer, the term of this patent is extended or adjusted under 35 U.S.C. 154(b) by 399 days.

(21) Appl. No.: 17/072,684

(22) Filed: Oct. 16, 2020

(65) Prior Publication Data

US 2021/0222915 A1 Jul. 22, 2021

(30) Foreign Application Priority Data

Jan. 22, 2020 (KR) ..... 10-2020-0008478

(51) Int. Cl.

| | |
|---|---|
| ***F25B 1/02*** | (2006.01) |
| ***F04B 39/12*** | (2006.01) |
| ***F25B 31/02*** | (2006.01) |
| ***F04B 17/04*** | (2006.01) |
| ***F04B 35/04*** | (2006.01) |

(52) U.S. Cl.

CPC ..... *F25B 1/02* (2013.01); *F04B 17/04* (2013.01); *F04B 39/122* (2013.01); *F25B 31/023* (2013.01); *F04B 35/045* (2013.01); *F25B 2400/073* (2013.01)

(58) Field of Classification Search

CPC .... F25B 1/02; F25B 31/023; F25B 2400/073; F04B 35/045; F04B 17/04

See application file for complete search history.

(56) References Cited

U.S. PATENT DOCUMENTS

| | | | | |
|---|---|---|---|---|
| 6,361,049 | B1 * | 3/2002 | Joco | F16J 15/062 277/910 |
| 8,053,668 | B2 * | 11/2011 | Lai | H05K 9/0009 277/641 |
| 10,968,907 | B2 * | 4/2021 | Ahn | F04B 39/0238 |
| 2014/0053720 | A1 * | 2/2014 | Ahn | F04B 39/122 91/418 |
| 2018/0051685 | A1 * | 2/2018 | Hahn | F04B 35/04 |
| 2019/0107312 | A1 * | 4/2019 | Noh | F04B 19/04 |
| 2019/0353155 | A1 * | 11/2019 | Ahn | F04B 53/166 |
| 2020/0003198 | A1 | 1/2020 | Noh et al. | |

FOREIGN PATENT DOCUMENTS

| | | |
|---|---|---|
| KR | 1020160011009 | 1/2016 |
| KR | 101981101 | 5/2019 |
| KR | 102060175 | 12/2019 |

OTHER PUBLICATIONS

KR Office Action in Korean Appln. No. 10-2020-0008478, dated Nov. 24, 2020, 10 pages (with English translation).

Office Action in German Appln. No. 102021200101.7, dated Dec. 8, 2021, 10 pages (with English translation).

* cited by examiner

*Primary Examiner* — Christopher S Bobish

(74) *Attorney, Agent, or Firm* — Fish & Richardson P.C.

(57) ABSTRACT

A linear compressor includes a hole that is defined in a discharge cover, and is configured such that a portion of a refrigerant discharged through an opened discharge valve is guided to flow to the hole. Accordingly, a discharge passage for the refrigerant used as a gas bearing may be easily defined.

21 Claims, 10 Drawing Sheets

LINEAR COMPRESSOR

CROSS-REFERENCE TO RELATED APPLICATION

The present application claims priority under 35 U.S.C. 119 and 35 U.S.C. 365 to Korean Patent Application No. 10-2020-0008478, filed on Jan. 22, 2020, which is hereby incorporated by reference in its entirety.

TECHNICAL FIELD

The present disclosure relates to a linear compressor.

BACKGROUND

In a reciprocating compressor, a compression space for compressing a working gas is defined between a piston and a cylinder. While the piston linearly reciprocates within the cylinder, a refrigerant introduced into the compression space is compressed.

Recently, in the reciprocating compressors, a linear compressor, which is directly connected to a driving motor, in which a piston linearly reciprocates, to improve compression efficiency without mechanical losses occurring when a rotation motion of the motor is converted into a linear motion and has a simple structure, is being widely developed.

In general, the linear compressor suctions and compresses a refrigerant within a sealed shell while a piston linearly reciprocates within a cylinder by a linear motor and then discharges the compressed refrigerant.

The linear compressor may employ a "gas bearing" technology in which a refrigerant gas is supplied to an outer circumferential surface of a piston to serve as a bearing. The refrigerant gas is a portion of a compressed high-pressure gas, which is introduced into the cylinder through an inflow portion provided in the cylinder and serves as a bearing for a reciprocating piston.

A linear compressor is disclosed in Korean Patent Publication No. 10-2016-0011009 (Jan. 29, 2016) that is a prior art document. The linear compressor according to the related art may have following limitations.

A high-temperature refrigerant compressed in a compression space of the cylinder flows to a discharge cover through a discharge valve and then flows to an outer circumferential surface of the cylinder through a gap between the discharge cover and a peripheral structure. Here, the high-temperature refrigerant transfers heat to a frame or the cylinder coupled to the discharge cover.

The heat is transferred to the refrigerant suctioned into the cylinder to increase in temperature of the suction refrigerant, and thus, to increase in temperature of a discharge refrigerant in the compressor, thereby reducing operating efficiency of the compressor.

PRIOR ART DOCUMENT

Patent Document (Patent Document 1) Korean Patent Publication No. 10-2016-0011009 (Jan. 29, 2016), Title of The Invention: LINEAR COMPRESSOR

SUMMARY

Embodiments provide a linear compressor provided with a structure in which a passage for a discharge refrigerant (hereinafter, referred to as a discharge passage) is provided in a discharge cover assembly to guide a smooth flow of the discharge refrigerant.

Embodiments also provide a linear compressor in which a discharge passage is directly connected to a frame channel of a frame so that a refrigerant is widely spread into an inner space of a discharge cover so as not to flow through an outer circumferential surface of the discharge cover, thereby reducing an amount of heat of a high-temperature refrigerant, which is transferred to a suction-side of a compressor through the discharge cover.

Embodiments also provide a linear compressor in which a hole is defined in a discharge cover to easily define a discharge passage.

Embodiments also provide a linear compressor in which a bearing sealer is provided on the hole to prevent a high-temperature refrigerant from leaking to a structure surrounding the discharge cover by getting out of the discharge passage.

In the linear compressor according to an embodiment, since a hole is defined in a discharge cover, and a portion of a refrigerant discharged through an opened discharge valve is guided to flow to the hole, a discharge passage for the refrigerant used as a gas bearing may be easily defined.

Particularly, the hole may be defined in only one side of the discharge cover so that the discharge passage is defined only in one direction with respect to a center of the discharge cover to prevent the high-temperature refrigerant from being spread to the inner space of the discharge cover. Therefore, an amount of heat of the high-temperature refrigerant, which is transferred to a suction-side of the compressor through the discharge cover, may be reduced.

Also, a bearing sealer may be provided on the hole of the discharge cover to prevent the refrigerant flowing through the discharge passage from leaking to the periphery of the hole.

Also, the bearing sealer may include a first part inserted into a cover housing and a second part inserted into a frame so as to be stably supported on a boundary-side between the cover housing and the frame.

Particular implementations of the present disclosure can include a linear compressor that includes a discharge cover, a cover housing, a frame, a cylinder, a nozzle, and a bearing sealer. The discharge cover can support a discharge valve. The cover housing can receive the discharge cover and define a housing chamber. The frame can be coupled to the cover housing. The cylinder can be inserted into the frame and receive a piston. The piston can be configured to reciprocate in the cylinder in an axial direction. The nozzle can be disposed at the cylinder and be configured to introduce, into the cylinder, refrigerant that is discharged through the discharge valve. The bearing sealer can be disposed at an interface between the frame and the cover housing and define a passage for the refrigerant that is transferred to the nozzle.

In some implementations, the linear compressor can optionally include one or more of the following features. the discharge cover can include a cover hole that is defined at the bearing sealer and configured to enable discharge of the refrigerant from the housing chamber. The discharge cover can include a cover body, and a cover flange that is connected to the cover body and that extends in a radial direction. The cover hole is defined at the cover flange. The bearing sealer can be disposed to contact the cover flange. The discharge cover can include a stepped portion that extends from the cover flange in an axial direction, and a seating portion that extends from the stepped portion in the radial direction and that receives a spring assembly that is coupled to the discharge valve. A first bracket sealing member can be disposed between the spring assembly and the seating portion. The discharge cover can include a cover inner wall, a collar, and a wall connection portion. The cover inner wall can be connected to the seating portion, extend in the axial direction, and be surrounded by the cover body. The collar can be disposed at a central portion of the discharge cover, extend in the axial direction, and define a discharge hole for the refrigerant. The wall connection portion can connect the collar to the cover inner wall. The cover housing can include a housing body, and a housing inner wall that is surrounded by the housing body and that extends in an axial direction. The cover body and the cover flange can be disposed between the housing inner wall and the housing body. The bearing sealer can include a first part that is received in the cover housing, and a second part that is connected to the first part and received in the frame. The frame can include a sealer groove that receives the second part of the bearing sealer, and a frame channel that is fluidly connected to the sealer groove, that extends through an outer circumferential surface of the cylinder, and that is configured to supply the refrigerant to the cylinder. The bearing sealer can include a through-hole that provides a passage for the refrigerant that passes through the cover hole. The through-hole can define a refrigerant channel at the first part and the second part of the bearing sealer. The refrigerant channel can include first, second, and third refrigerant channels. The first refrigerant channel can be defined at the first part of the bearing sealer. The second refrigerant channel can be defined at the second part of the bearing sealer. The third refrigerant channel can fluidly connect the first refrigerant channel to the second refrigerant channel. The third refrigerant channel can include (i) a first region that is defined at the first part of the bearing sealer and (ii) a second region that is defined at the second part of the bearing sealer. The first refrigerant channel can have a first inner diameter that is greater than each of an inner diameter of the cover hole and a third inner diameter of the third refrigerant channel. The second refrigerant channel can have a second inner diameter that is greater than the first inner diameter of the first refrigerant channel. The first part and the second part can be disposed eccentrically with respect to the axial direction. The bearing sealer includes rubber.

Particular implementations of the present disclosure can include a linear compressor that includes a discharge valve, a cover, a frame, a cylinder, and a bearing sealer. The discharge cover can support a discharge valve. The cover housing can receive the discharge cover and define a housing chamber. The frame can be coupled to the cover housing. The cylinder can be inserted into the frame and receive a piston. The piston can be configured to reciprocate in the cylinder in an axial direction. The bearing sealer can be disposed at an interface between the frame and the cover housing and define a passage for refrigerant.

In some implementations, the linear compressor can optionally include one or more of the following features. The discharge cover can include a cover hole that is defined at the bearing sealer and that is configured to discharge the refrigerant in the housing chamber. The discharge cover can include a cover body, and a cover flange that is connected to the cover body and that extends in a radial direction. The cover hole can be defined at the cover flange. The bearing sealer can be disposed to contact the cover flange. The discharge cover can include a stepped portion that extends from the cover flange in an axial direction, and a seating portion that extends from the stepped portion in the radial direction and that receives a spring assembly that is coupled to the discharge valve. A first bracket sealing member can be disposed between the spring assembly and the seating portion. The discharge cover can include a cover inner wall, a collar, and a wall connection portion. The cover inner wall can be connected to the seating portion, extend in the axial direction, and be surrounded by the cover body. The collar can be disposed at a central portion of the discharge cover, extend in the axial direction, and define a discharge hole for the refrigerant. The wall connection portion can connect the collar to the cover inner wall.

In one embodiment, a linear compressor includes: a discharge cover configured to support a discharge valve and define a cover chamber; a cover housing on which the discharge cover is placed, the cover housing being configured to define a housing chamber; a frame coupled to the cover housing; a cylinder which is inserted into the frame and into which a piston configured to reciprocate in an axial direction is inserted; a nozzle provided in the cylinder to introduce a portion of a refrigerant discharged through the discharge valve into the cylinder; and a bearing sealer which is provided on a boundary surface on which the frame and the cover housing are coupled to each other and through which the refrigerant transferred to the nozzle passes.

The discharge cover may include a cover hole defined in an inlet side of the bearing sealer to discharge the refrigerant in the housing chamber.

The discharge cover may include a cover body and a cover flange connected to an edge of the cover body to extend in a radial direction, and the cover hole may be defined in the cover flange.

The bearing sealer may be disposed to contact the cover flange.

The discharge cover may further include: a stepped portion extending from the cover flange in an axial direction; and a seating portion which extends from the stepped portion in the radial direction and on which a spring assembly coupled to the discharge valve is placed, A first bracket sealing member may be installed between the spring assembly and the seating portion.

The discharge cover may further includes: a cover inner wall connected to the seating portion, the cover inner wall being provided inside the cover body in the axial direction; a collar which is provided at a central portion of the discharge cover in the axial direction and in which a discharge hole for the refrigerant is defined; and a wall connection portion configured to connect the collar to the cover inner wall.

The cover housing may include a housing body and a housing inner wall provided inside the housing body in an axial direction, and the cover body and the cover flange may be disposed between the housing inner wall and the housing body.

The bearing sealer may include: a first part inserted into the cover housing; and a second part connected to the first part, the second part being inserted into the frame.

The frame may include: a sealer groove into which the second part is inserted; and a frame channel connected to the sealer groove, the frame channel being defined to pass through an outer circumferential surface of the cylinder so as to supply the refrigerant to the cylinder.

The bearing sealer may include a through-hole through which the refrigerant passing through the cover hole flows, and the through-hole may be configured to define a refrigerant channel of the first part and the second part.

The refrigerant channel may include: a first refrigerant channel defined in the first part; a second refrigerant channel defined in the second part; and a third refrigerant channel configured to connect the first and second refrigerant channels to each other, the third refrigerant channel comprising a first region defined inside the first part and a second region defined inside the second part.

The first refrigerant channel may have an inner diameter (D1) greater than each of an inner diameter of the cover hole and an inner diameter (D3) of the third refrigerant channel.

The second refrigerant channel may have an inner diameter (D2) greater than the inner diameter (D1) of the first refrigerant channel.

The first part and the second part may be disposed eccentrically with respect to the axial direction.

The bearing sealer may be made of rubber.

The details of one or more embodiments are set forth in the accompanying drawings and the description below. Other features will be apparent from the description and drawings, and from the claims.

DETAILED DESCRIPTION

Figure 1:
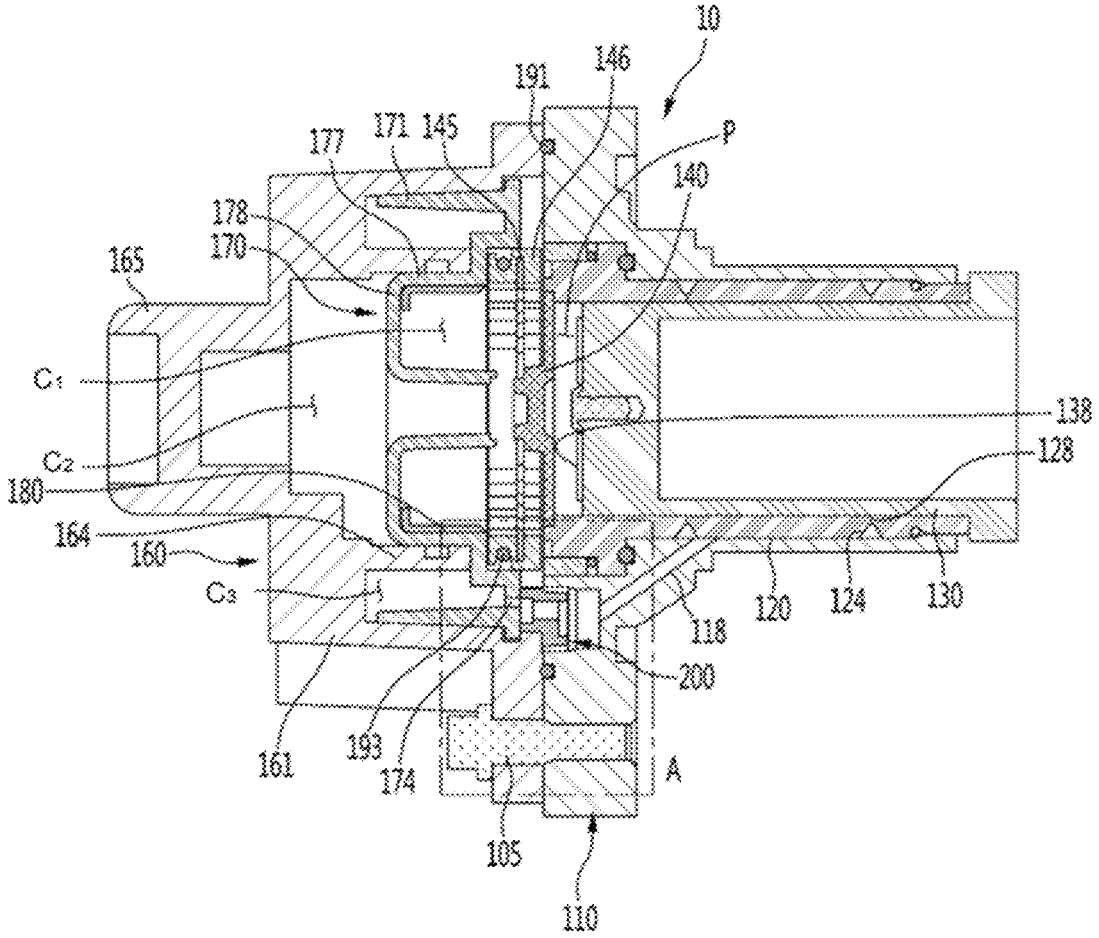
FIG. 1 is a cross-sectional view illustrating a portion of constituents of a linear compressor according to an embodiment.

Hereinafter, some embodiments of the present disclosure will be described in detail with reference to the accompanying drawings. It is noted that the same or similar components in the drawings are designated by the same reference numerals as far as possible even if they are shown in different drawings. In the following description of the present disclosure, a detailed description of known functions and configurations incorporated herein will be omitted to avoid making the subject matter of the present disclosure unclear.

In the description of the elements of the present disclosure, the terms first, second, A, B, (a), and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
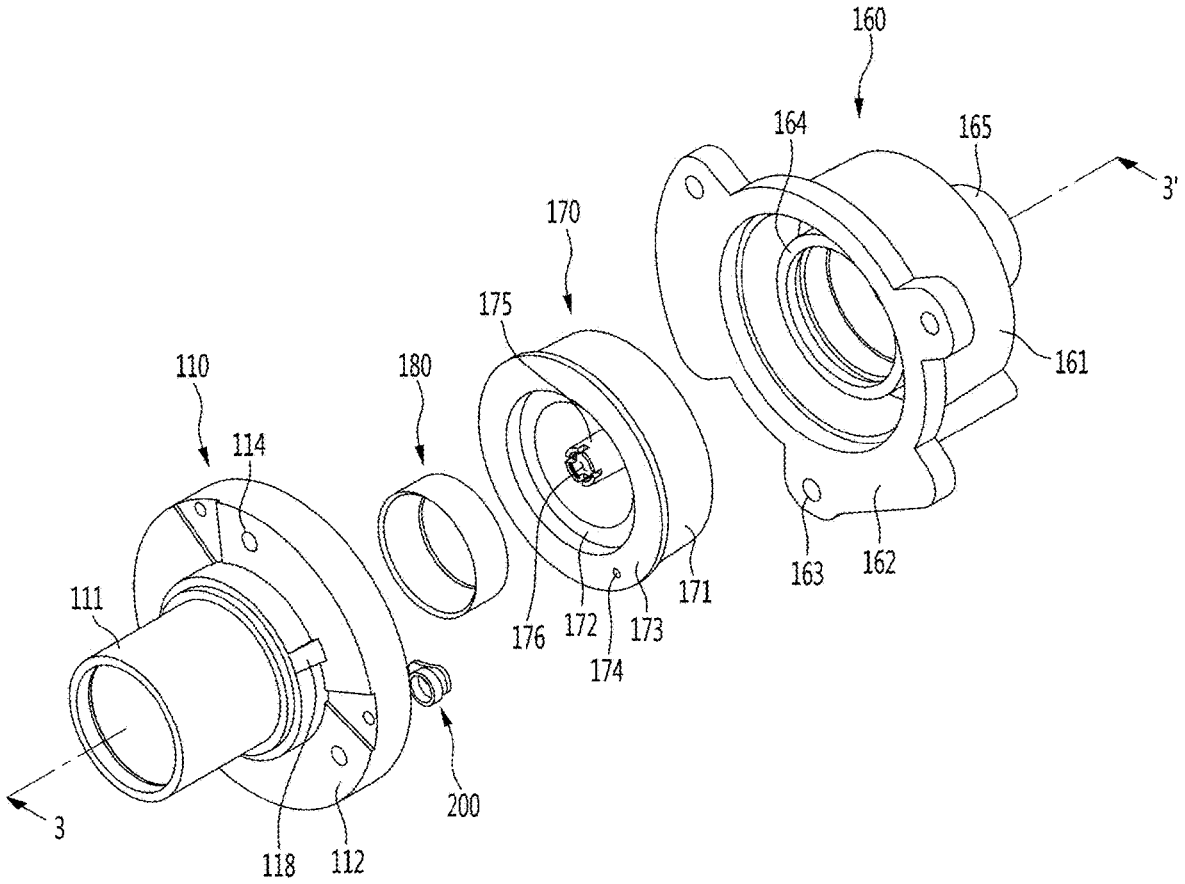
FIG. 2 is an exploded perspective view illustrating constituents of a frame and a discharge cover assembly according to an embodiment.
Figure 3:
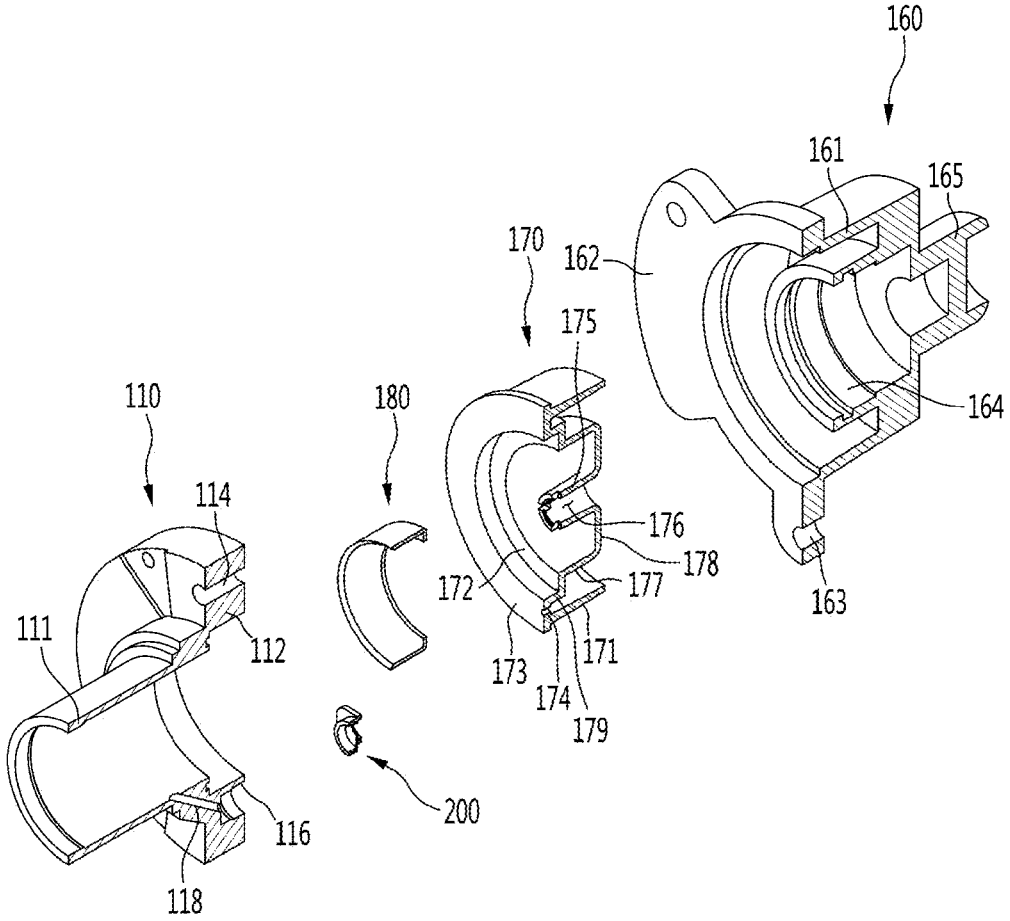
FIG. 3 is a cross-sectional view taken along line 3-3' of FIG. 2.
Figure 4:
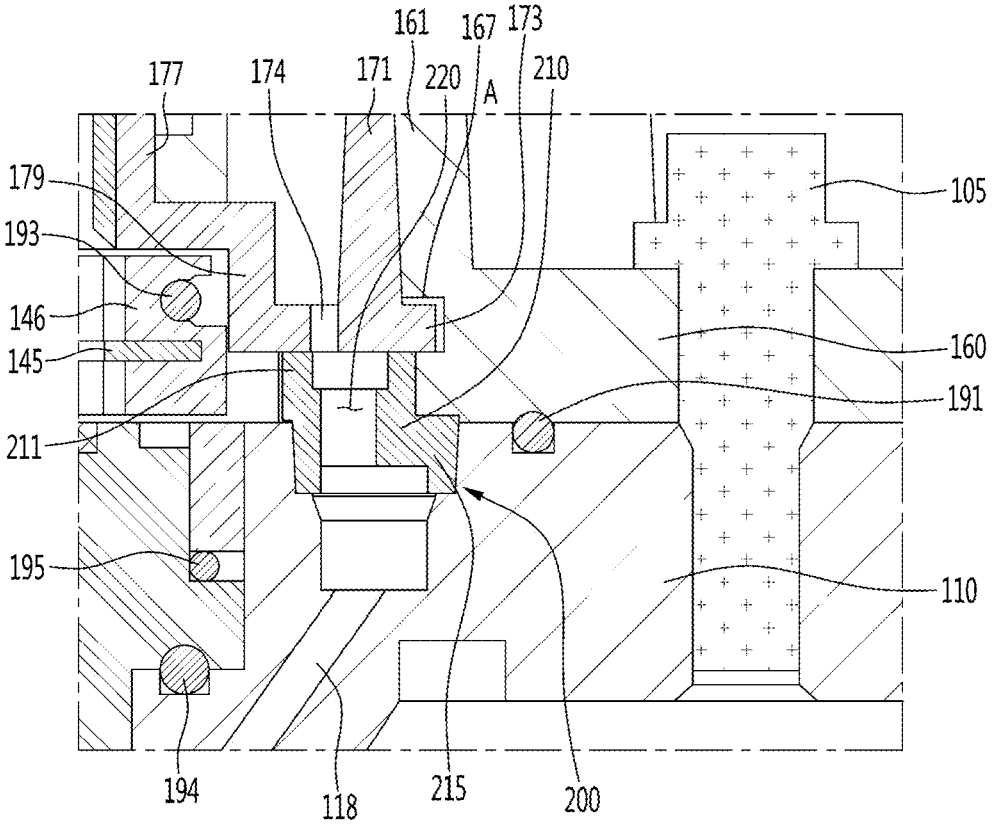
FIG. 4 is an enlarged cross-sectional view illustrating a portion "A" of FIG. 1.

FIG. 1 is a cross-sectional view illustrating a portion of constituents of a linear compressor according to an embodiment, FIG. 2 is an exploded perspective view illustrating constituents of a frame and a discharge cover assembly according to an embodiment, FIG. 3 is a cross-sectional view taken along line 3-3' of FIG. 2, and FIG. 4 is an enlarged cross-sectional view illustrating a portion "A" of FIG. 1.

Referring to FIG. 1, a linear compressor 10 according to an embodiment includes a frame 110 provided inside a compressor shell, a cylinder 120 inserted into the frame 110, and a piston 130 linearly reciprocating inside the cylinder 120. The piston 130 may reciprocate in an axial direction.

The frame 110 is understood as a constituent for fixing the cylinder 120. For example, the cylinder 120 may be press-fitted into the inside of the frame 110. Also, the frame 110 is disposed to surround the cylinder 120.

In detail, the frame 110 has a hollow cylindrical shape and includes a frame body 111 defining a space into which the cylinder 120 is inserted and a frame flange 112 extending radially from a front portion of the frame body 111.

A cylinder sealing member 194 may be provided between the frame 110 and the cylinder 120. Adhesion force between the frame 110 and the cylinder 120 may increase by the cylinder sealing member 194 while the cylinder 120 is press-fitted into the frame 110.

The frame 110 provides a frame channel 118 extending obliquely with respect to the axial direction from the frame flange 112 toward the frame body 111. A refrigerant acting as a gas bearing may flow through the frame channel 118.

The direction will be defined.

The "axial direction" may be understood as a direction in which the piston 130 reciprocates, i.e., the horizontal direction in FIG. 1. Also, in the "axial direction", a direction from the suction valve 138 toward a compression space P of the cylinder 120, i.e., a direction in which the refrigerant flows may be defined as a "front direction", and a direction opposite to the front direction may be defined as a "rear direction". When the piston 130 moves forward, the compression space P is reduced, and when the piston 130 moves backward, the compression space P may be expanded.

On the other hand, the "radial direction" may be understood as a direction that is perpendicular to the direction in which the piston 130 reciprocates, i.e., the vertical direction in FIG. 1.

The cylinder 120 has a compression space P in which the refrigerant is compressed by the piston 130. Also, a suction hole through which the refrigerant is introduced into the compression space P is defined in the front portion of the piston 130, and a suction valve 138 that selectively opens the suction hole is provided in front of the suction hole.

Discharge cover assembles 160, 170, 180, and 200 defining a discharge space for the refrigerant discharged from the compression space P are provided in front of the compression space P.

Each of the discharge cover assemblies includes a cover housing 160 fixed to a front surface of the frame 110 and a discharge cover 170 disposed inside the cover housing 160 to define a discharge passage for the refrigerant.

The cover housing 160 is coupled to the frame flange 112 by a coupling member 105, and a front surface of the frame flange 112 may be in surface contact with a rear surface of the cover housing 160. A frame coupling hole 114 into which the coupling member 105 is inserted may be defined in the frame flange 112. The frame coupling hole 114 may be provided in plurality.

A frame sealing member 191 that is capable of increasing in the coupling force and preventing leakage of the refrigerant may be provided on a portion at which the cover housing 160 and the frame 110 are in surface contact with each other. Also, an amount of heat that is conducted from the discharge cover assembly to the frame 110 may be reduced by the frame sealing member 191.

The cover housing 160 includes a housing body 161 having a hollow cylindrical shape and a housing inner wall 164 extending in an axial direction from an inner surface of the housing body 161. The housing inner wall 164 may have a hollow cylindrical shape.

The housing body 161 is disposed to surround the housing inner wall 164, and a spaced space into which a portion of the discharge cover 170 is inserted is defined between the housing body 161 and the housing inner wall 164. The spaced space defines a third discharge chamber C3.

The cover housing 160 further includes a housing flange 162 extending radially from a rear edge of the housing body 161. A housing coupling hole 163 may be defined in the housing flange 162, and the coupling member 105 may be inserted into the housing coupling hole 163.

The cover housing 160 further includes a shell support 165 extending forward from a front end of the housing body 161 and connected to a shell of the compressor. A damper unit (not shown) is coupled to the shell support 165, and the damper unit may connect the shell support 165 to the shell of the compressor.

The discharge cover 170 may be inserted into the cover housing 160 and supported by a support protrusion 167 of the cover housing 160. The support protrusion 167 may be configured to be stepped on the inner surface of the housing body 161. In detail, the cover flange 173 of the discharge cover 170 may be supported on the support protrusion 167.

The discharge cover 170 includes a cover body 171 having a hollow cylindrical shape and a cover flange 173 that is connected to a rear edge of the cover body 171 to extend in the radial direction.

The cover body 171 and the cover flange 173 may be inserted into a spaced space C3 (third discharge chamber) between the housing body 161 and the housing inner wall 164.

A cover hole 174 through which the refrigerant flows may be defined in the cover flange 173. The cover hole 174 may be defined in the third discharge chamber C3.

The discharge cover 170 further includes a stepped portion 179 extending in the axial direction (front direction) from the cover flange 173 and a seating portion 172 extending radially from the stepped portion 179. Spring assemblies 145 and 146, which will be described later, are seated on the seating portion 172, and the seating portion 172 may have a ring shape.

The discharge cover 170 may be provided inside the cover body 171 and may further include a cover inner wall 177 having a hollow cylindrical shape. The cover inner wall 177 may extend in the axial direction (front direction) from the seating portion 172.

The cover inner wall 177 may be disposed to contact the housing inner wall 164 of the cover housing 160. That is, the cover inner wall 177 may be inserted into the housing inner wall 164.

The discharge cover 170 further includes a collar 175 provided in the axial direction from the center of the discharge cover 170. The collar 175 may be provided inside the cover inner wall 177.

Also, the discharge cover 170 further includes a wall connection portion 178 connecting the collar 175 to the cover inner wall 177. The wall connection portion 178 is provided in the radial direction and may connect a front portion of the cover inner wall 177 to a front portion of the collar 175.

The collar 175 has a hollow column shape, and a refrigerant discharge hole 176 may be defined inside the collar. The compressed refrigerant existing in the inner space of the discharge cover 170 may flow into the inner space of the cover housing 160 through the discharge hole 176.

In detail, the inner space of the discharge cover 170 defines a first discharge chamber C1 for the refrigerant. The first discharge chamber C1 may be a space defined by the cover inner wall 177, the wall connection portion 178, and the collar 175.

The inner space of the cover housing 160 defines a second discharge chamber C2 for the refrigerant. The second discharge chamber C2 may be a space defined by the housing inner wall 164 and the shell support 165.

A portion of the refrigerant discharged through the discharge valve 140 may pass through the first discharge chamber C1, the second discharge chamber C2, and the third discharge chamber C3 and then be supplied to an outer circumferential surface of the cylinder 120 to flow to the inside of the cylinder, thereby acting as a gas bearing.

For convenience of explanation, the first discharge chamber C1 may be referred to as a "cover chamber", and each of the second and third discharge chambers C2 and C3 may be referred to as a "housing chamber".

The discharge cover assembly 290 may further include a cylindrical fixing ring 180 that is in close contact with an inner circumferential surface of the discharge cover 170. The fixing ring 180 may be made of a material having a thermal expansion coefficient different from that of the discharge cover 170 to prevent the discharge cover 170 from being separated from the cover housing 160.

For example, the discharge cover 170 may be made of engineering plastic that withstands a high temperature, the cover housing 160 may be made of aluminum die cast, and the fixing ring 180 may be made of stainless steel.

A discharge valve assembly may be provided to the discharge cover assembly. The discharge valve assembly may include a discharge valve 140 and spring assemblies 145 and 146 providing elastic force in a direction in which the discharge valve 140 is in close contact with the front end of the cylinder 120.

The spring assemblies 145 and 146 include a valve spring 145 provided as a plate spring and a spring bracket 146 surrounding an edge of the valve spring 145 to support the valve spring 145.

The discharge valve 140 is coupled to a central portion of the valve spring 145. When the discharge valve 140 is opened, the refrigerant compressed in the compression space P of the cylinder 120 is discharged to flow into the inner space of the discharge cover 170. When the discharge of the refrigerant is completed, the discharge valve 140 may be closed by restoring force of the valve spring 145.

The spring bracket 146 may be seated on the seating portion 172 of the discharge cover 170. A first bracket sealing member 193 may be provided between each of the spring assemblies 145 and 146 and the discharge cover 170.

The first bracket sealing member 193 may be provided on a contact surface between the spring bracket 146 and the discharge cover 170 to prevent the refrigerant from leaking through a space between the discharge cover 170 and each of the spring assemblies 145 and 146. For example, the first bracket sealing member 193 may be provided between the spring bracket 146 and the stepped portion 179.

A second bracket sealing member 195 may be provided between each of the spring assemblies 145 and 146 and the cylinder 120. The second bracket sealing member 195 may be provided on a contact surface between the spring bracket 146 and the cylinder 120 to prevent the refrigerant from leaking through a space between the cylinder 120 and each of the spring assemblies 145 and 146.

A portion of the refrigerants discharged from the discharge valve 140 may function as the gas bearing for levitation of the position within the cylinder 120.

For this, a bearing groove 124 into which the refrigerant is introduced is defined in the cylinder 120. The bearing groove 124 may be provided in plurality. The plurality of bearing grooves 124 may be defined in a circumferential direction in the outer circumferential surface of the cylinder 120 so as to be spaced apart from each other in the axial direction.

A refrigerant filter may be installed on the bearing groove 124. Also, a nozzle 128 passing from the bearing groove 124 to the inner circumferential surface of the cylinder 120 may be disposed in the cylinder 120. The refrigerant may be supplied from the bearing groove 124 to the outer circumferential surface of the piston 130 via the nozzle 128.

The frame channel 118 of the frame 110 may communicate with the bearing groove 124 of the cylinder 120. The refrigerant passing through the discharge cover assembly may flow toward the frame 110 via the cover hole 174 and may flow into the bearing groove 124 via the frame channel 118.

A bearing sealer 200 may be installed on a boundary surface between the cover housing 160 and the frame 110. The bearing sealer 200 may be installed adjacent to an inlet-side of the frame channel 118. Also, the bearing sealer 200 may be made of a flexible rubber material.

The bearing sealer 200 may transfer the refrigerant passing through the cover hole 174 of the discharge cover 170 to the frame channel 118 of the frame 110. In this process, the refrigerant may be prevented from leaking to the outside of each of the cover housing 160 and the frame 110.

The bearing sealer 200 may be disposed to be inserted into the cover housing 160 and the frame 110. That is, a portion of the bearing sealer 200 may be inserted into the cover housing 160, and the other portion may be inserted into the frame 110.

A sealer groove 116 into which a portion of the bearing sealer 200 is inserted is defined to be recessed in the frame 110. The sealer groove 116 may be recessed backward from a front surface of the frame flange 112.

The bearing sealer 200 includes a sealer body 210 inserted into the discharge cover 170 and the cover housing 160 and a through-hole 220 which is defined in the sealer body 210 and through which the refrigerant discharged from the cover hole 174 of the discharge cover 170 flows. The through-hole 220 may be understood as a refrigerant passage defined in the bearing sealer 200.

The bearing sealer 200 is provided to contact the discharge cover 170. In detail, the discharge cover 170 and the bearing sealer 200 are in surface contact with each other, and the cover hole 174 and the through-hole 220 may be aligned to communicate with each other.

Figure 5:
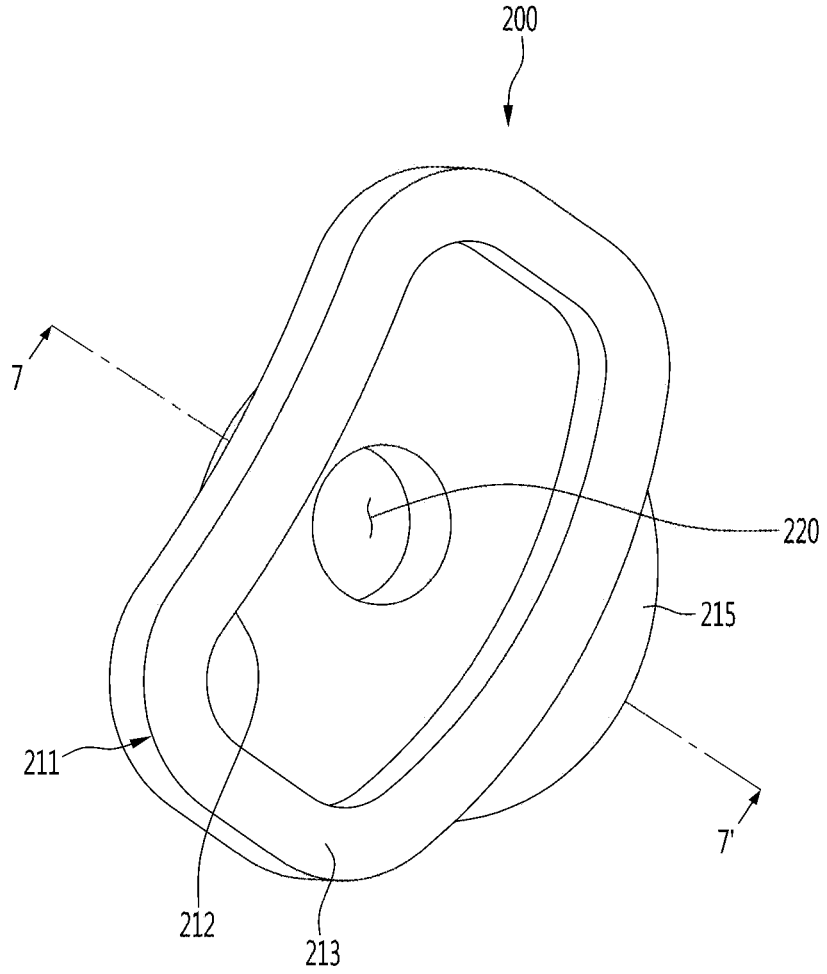
FIG. 5 is a perspective view illustrating a front configuration of a bearing sealer according to an embodiment.
Figure 6:
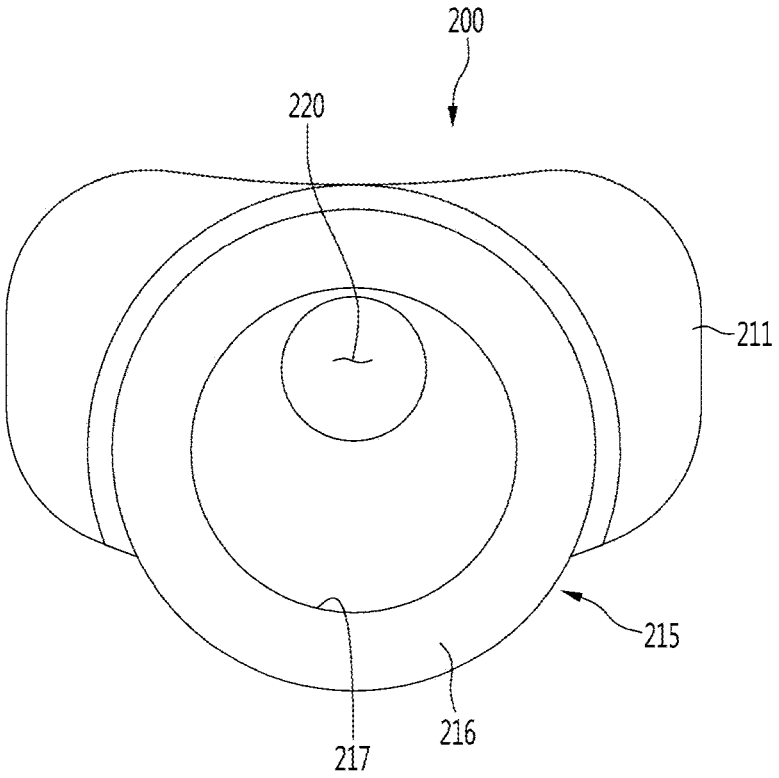
FIG. 6 is a perspective view illustrating a rear configuration of the bearing sealer according to an embodiment.
Figure 7:
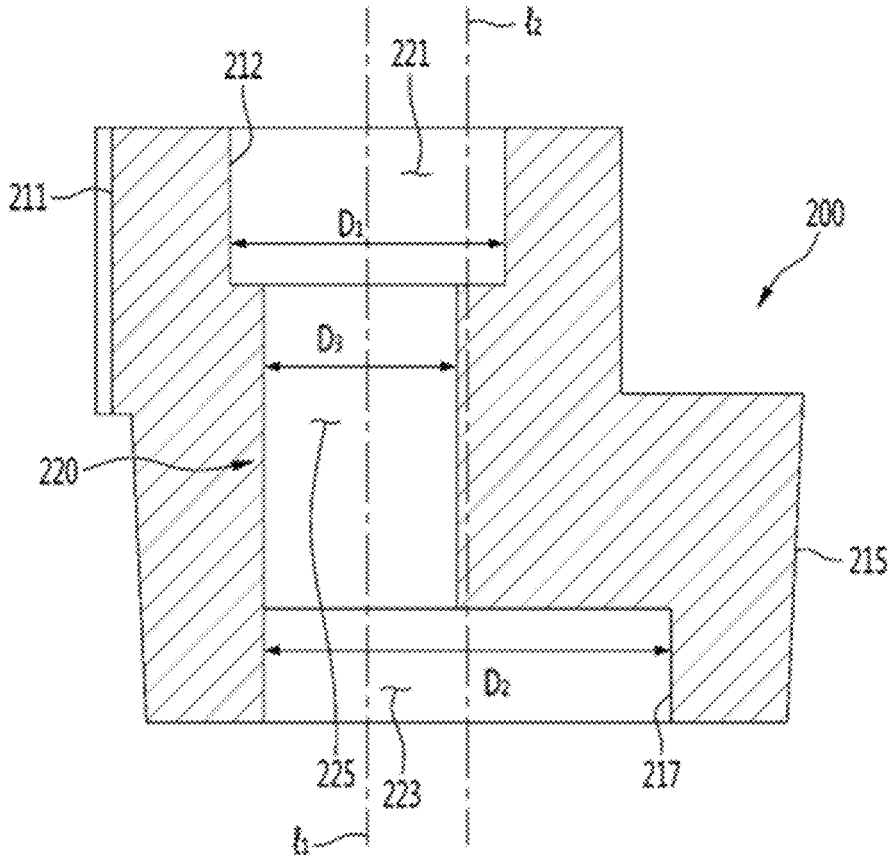
FIG. 7 is a cross-sectional view taken along line 7-7' of FIG. 5.

FIG. 5 is a perspective view illustrating a front configuration of the bearing sealer according to an embodiment, FIG. 6 is a perspective view illustrating a rear configuration of the bearing sealer according to an embodiment, and FIG. 7 is a cross-sectional view taken along line 7-7' of FIG. 5.

Referring to FIGS. 5 to 7, the bearing sealer 200 according to an embodiment includes a first part 211 inserted into the cover housing 160 and a second part 215 inserted into the frame 110.

The first part 211 may be inserted into the cover housing 160 through a rear end of the cover housing 160 to contact the discharge cover 170, i.e., the cover flange 173.

The first part 211 may have a substantially hollow polygonal shape. In detail, the first part 211 may include a contact surface 213 in contact with the discharge cover 170. Also, a first recess 212 defining a first refrigerant channel 221 is defined in a central portion of the first part 211. The first refrigerant channel 221 defines a portion of the through-hole 220.

The first and second parts may be provided to be eccentric with respect to the axial direction. In detail, the first extension line l1 in the axial direction, which passes through a center of the first part 211 may be spaced apart from a second extension line l1 in the axial direction, which passes through a center of the second part 215.

The second part 215 may be integrated with the first part 211.

The second part 215 may be inserted into the sealer groove 116 of the frame 110 to contact the inner surface of the sealer groove 116.

The second part 215 may have a substantially hollow cylindrical shape. In detail, the second part 215 may include a contact surface 216 in contact with the frame 110. Also, a second recess 217 defining a second refrigerant channel 223 is defined in a central portion of the second part 215. The second refrigerant channel 223 defines a portion of the through-hole 220.

A third refrigerant channel 225 connecting the first refrigerant channel 221 to the second refrigerant channel 223 is further defined in the through-hole 220. The third refrigerant channel 225 may be defined between the first refrigerant channel 221 and the second refrigerant channel 223.

The third refrigerant channel 225 may include a first region defined inside the first part 211 and a second region defined inside the second part 215.

The refrigerant discharged from the cover hole 174 of the discharge cover 170 may be introduced into the first refrigerant channel 221 to flow to the second refrigerant channel 223 via the third refrigerant channel 225.

The inner surface of the bearing sealer 200 in which the through-hole 220 is defined may be provided to be stepped. Due to the stepped inner surface, inner diameters of the first to third refrigerant channels 221, 223, and 225 may have different values.

For example, an inner diameter D1 of the first refrigerant channel 221 may be greater than an inner diameter D3 of the third refrigerant channel 225, and an inner diameter D2 of the second refrigerant channel 223 may be larger than the inner diameter D1 of the first refrigerant channel 221.

Also, the inner diameter D1 of the first refrigerant channel 221 may be larger than an inner diameter of the cover hole 174.

Due to the difference in inner diameter of the first to third refrigerant channels and the cover hole 174, the refrigerant may be introduced from the cover hole 174 to the first refrigerant channel 221, and thus, a flow cross-sectional area may increase to reduce a flow rate, thereby reducing noise.

When the refrigerant flows from the first refrigerant channel 221 to the third refrigerant channel 225, the flow cross-sectional area may decrease, and thus, the flow rate may increase to improve flow efficiency. When the refrigerant flows from the third refrigerant channel 225 to the second refrigerant channel 225, the flow rate may decrease to reduce the noise.

Figure 8A:
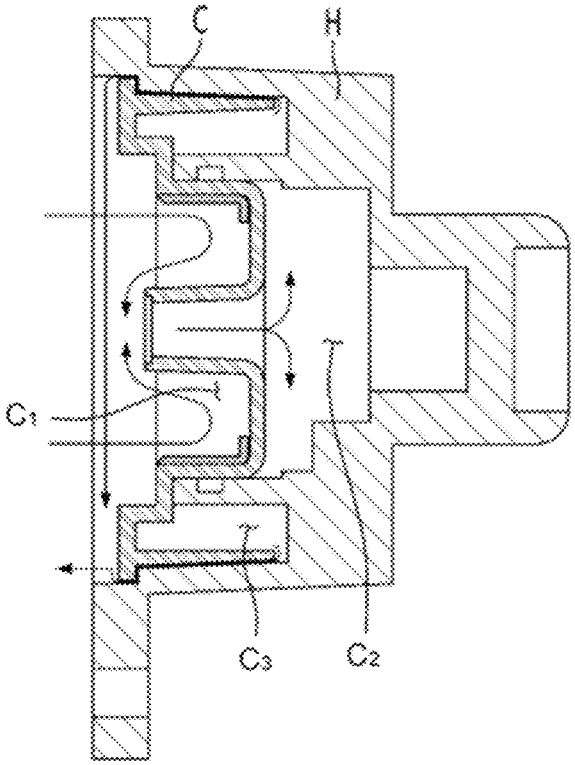
FIG. 8*a* is a cross-sectional view illustrating formation of a discharge passage when a structure according to an embodiment is not applied.
Figure 8B:
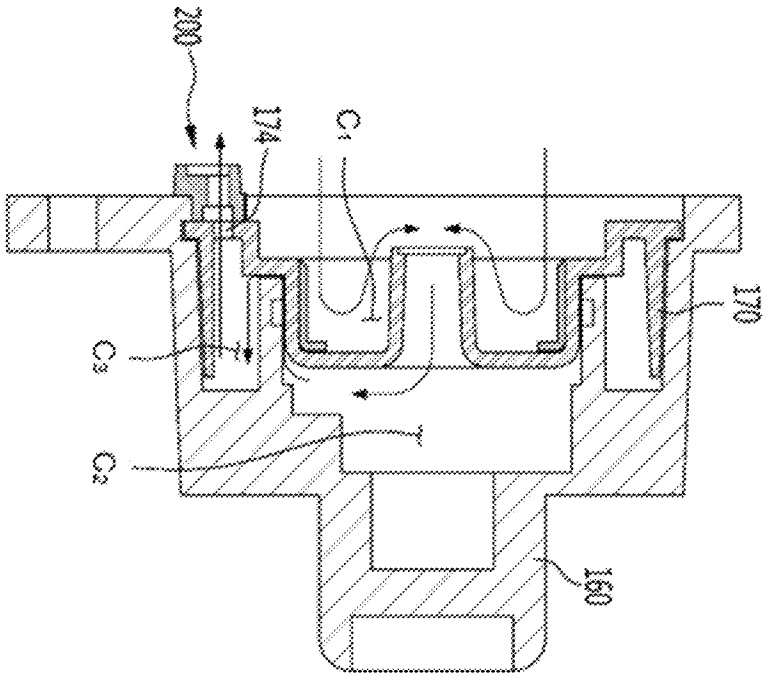
FIG. 8*b* is a cross-sectional view illustrating formation of the discharge passage when the structure according to an embodiment is applied.

FIG. 8*a* is a cross-sectional view illustrating formation of the discharge passage when the structure according to an embodiment is not applied, and FIG. 8*b* is a cross-sectional view illustrating formation of the discharge passage when the structure according to an embodiment is applied.

FIG. 8*a* illustrates a configuration of the discharge cover assembly to which the bearing sealer and the mounting structure thereof are not applied according to an embodiment.

When the high-temperature compressed refrigerant is discharged by opening the discharge valve, a portion of the discharged refrigerant flows to a first discharge chamber C1 of a discharge cover C and then flows a second discharge chamber C2 of a cover housing H through a collar of the discharge cover C.

The refrigerant in the second discharge chamber C2 may be spread widely toward an outer circumferential surface of the discharge cover C through a gap between the cover housing H and the discharge cover C and then may be introduced into the frame channel of the frame through a rear end of the cover housing H.

That is, a flow distance by which the refrigerant is introduced into the frame channel of the frame may be long, and thus, an amount of heat of the high-temperature refrigerant, which is transferred to the cover housing H and the discharge cover C may increase. The heat may be transferred to the suction-side of the compressor through the frame to cause an increase in temperature of the suction-side refrigerant.

Also, when the temperature of the suction-side refrigerant increases, the temperature of the discharge refrigerant in the compressor increases, and thus, operation efficiency of the compressor may be deteriorated.

On the other hand, FIG. 8*b* illustrates a configuration of the discharge cover assembly to which the bearing sealer and the mounting structure thereof are applied according to an embodiment.

When the high-temperature compressed refrigerant is discharged by opening the discharge valve, a portion of the discharged refrigerant flows to a first discharge chamber C1 of a discharge cover C and then flows a second discharge chamber C2 of a cover housing H through a collar of the discharge cover C.

The refrigerant in the second discharge chamber C2 may flow toward the cover flange 173 of the discharge cover 170 in which the cover hole 174 is defined. This is because a size of the cover hole 174 is larger than that of a gap between the cover housing H and the discharge cover C. Thus, it is possible to prevent the refrigerant from being spread widely toward the outer circumferential surface of the discharge cover C through the gap between the cover housing H and the discharge cover C.

That is, a flow distance by which the refrigerant is introduced into the frame channel of the frame may be relatively short, and thus, an amount of heat of the high-temperature refrigerant, which is transferred to the cover housing H and the discharge cover C may decrease. As a result, since an amount of heat transferred to the suction-side of the compressor decreases, an increase in temperature of the suction-side refrigerant may be reduced to improve the operation efficiency of the compressor.

Figure 9:
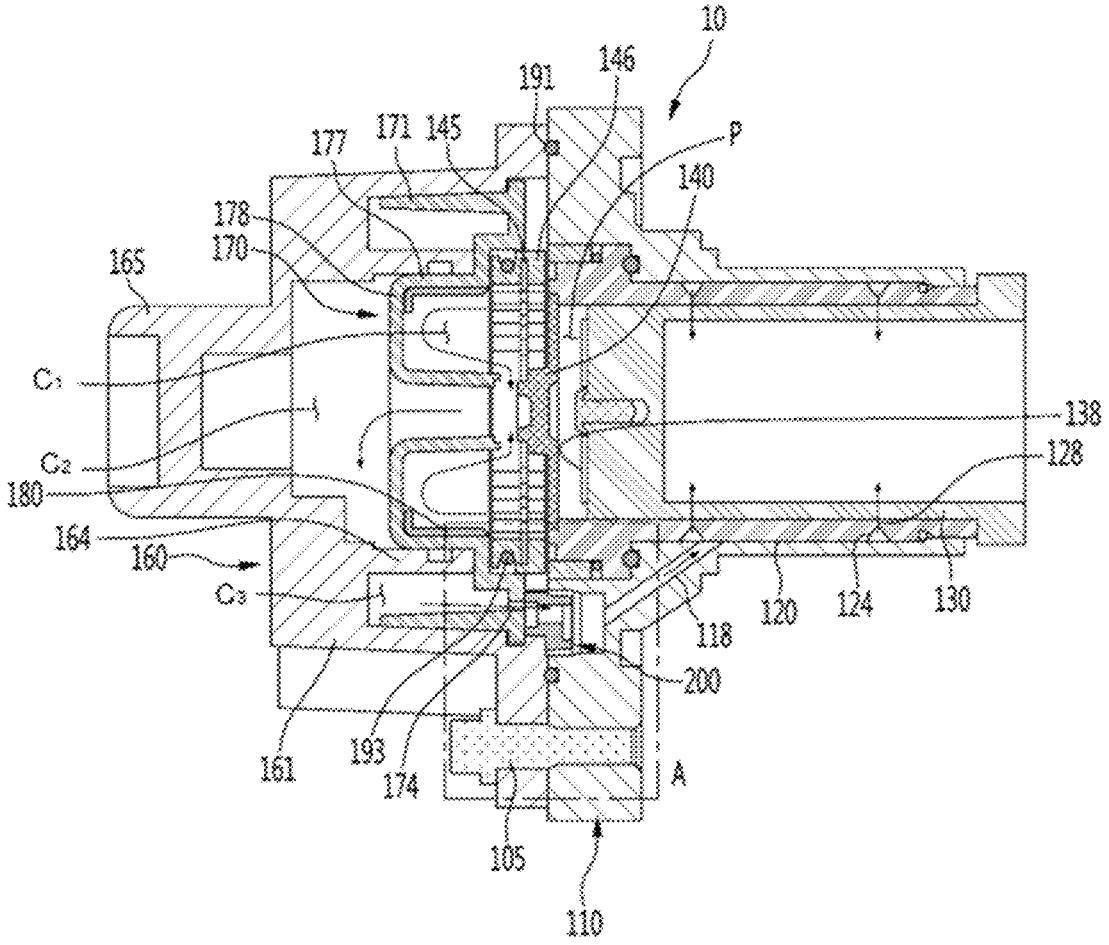
FIG. 9 is a cross-sectional view illustrating a discharge passage for a refrigerant transferred to a gas bearing in the linear compressor according to an embodiment.

FIG. 9 is a cross-sectional view illustrating the discharge passage for the refrigerant transferred to the gas bearing in the linear compressor according to an embodiment.

Referring to FIG. 9, when the discharge valve 140 according to the embodiment is opened, the high-temperature discharge refrigerant passes through the bearing sealer 200 through the inner space of the discharge cover assembly, as described in FIG. 8B. While the refrigerant passes through the bearing sealer 200, leakage of the refrigerant into the surrounding space of the cover housing 160 and the frame 110 may be prevented.

The refrigerant passing through the bearing sealer 200 is introduced into the frame channel 118 adjacent to the bearing sealer 200 to flow to the outer circumferential surface of the cylinder 120. Also, the refrigerant is introduced into the cylinder 120 through the bearing groove 124 and the nozzle 128 to provides levitation force to the reciprocating piston 130.

Due to the action of the refrigerant, the gas bearing effect to the piston may be improved, and the discharged refrigerant may be supplied to the cylinder-side through the short flow path to prevent the suction-side refrigerant in the compressor from increasing in temperature.

According to the above configuration, the structure for defining the discharge passage for the refrigerant may be provided in the discharge cover assembly to guide the smooth flow of the discharge refrigerant.

Particularly, the discharge passage may be directly connected to the frame channel of the frame so that the refrigerant is widely spread into the inner space of the discharge cover so as not to flow through the outer circumferential surface of the discharge cover, thereby reducing the amount of heat of the high-temperature refrigerant, which is transferred to the suction-side of the compressor through the discharge cover.

In addition, the hole may be defined in the discharge cover to easily define the discharge passage.

In addition, the bearing sealer may be provided on the hole to prevent the high-temperature refrigerant from leaking to the structure surrounding the discharge cover by getting out of the discharge passage.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a discharge cover that supports a discharge valve;

a cover housing that receives the discharge cover and that defines a housing chamber;

a frame that is coupled to the cover housing;

a cylinder that is inserted into the frame and that receives a piston, wherein the piston is configured to reciprocate in the cylinder in an axial direction;

a nozzle that is disposed at the cylinder and that is configured to introduce, into the cylinder, refrigerant that is discharged through the discharge valve; and a bearing sealer that is disposed at an interface between the frame and the cover housing and that comprises a through-hole defining a passage for the refrigerant that is transferred to the nozzle, wherein an inner surface of the through-hole is stepped such that a diameter of the passage varies.

2. The linear compressor according to claim 1, wherein the discharge cover comprises a cover hole that is defined at the bearing sealer and that is configured to enable discharge of the refrigerant from the housing chamber.

3. The linear compressor according to claim 2, wherein the discharge cover comprises:

a cover body; and a cover flange that is connected to the cover body and that extends in a radial direction, and wherein the cover hole is defined at the cover flange.

4. The linear compressor according to claim 3, wherein the bearing sealer is disposed to contact the cover flange.

5. The linear compressor according to claim 3, wherein the discharge cover further comprises:

a stepped portion that extends from the cover flange in an axial direction; and a seating portion that extends from the stepped portion in the radial direction and that receives a spring assembly that is coupled to the discharge valve, wherein a first bracket sealing member is disposed between the spring assembly and the seating portion.

6. The linear compressor according to claim 5, wherein the discharge cover further comprises:

a cover inner wall that is connected to the seating portion, that extends in the axial direction, and that is surrounded by the cover body;

a collar that is disposed at a central portion of the discharge cover, that extends in the axial direction, and that defines a discharge hole for the refrigerant; and a wall connection portion that connects the collar to the cover inner wall.

7. The linear compressor according to claim 5, wherein the discharge cover further comprises:

a cover inner wall that is connected to the seating portion, that extends in the axial direction, and that is surrounded by the cover body;

a collar that is disposed at a central portion of the discharge cover, that extends in the axial direction, and that defines a discharge hole for the refrigerant; and a wall connection portion that connects the collar to the cover inner wall.

8. The linear compressor according to claim 3, wherein the cover housing comprises:

a housing body; and a housing inner wall that is surrounded by the housing body and that extends in an axial direction, and wherein the cover body and the cover flange are disposed between the housing inner wall and the housing body.

9. The linear compressor according to claim 2, wherein the bearing sealer comprises:

a first part that is received in the cover housing; and a second part that is connected to the first part and received in the frame.

10. The linear compressor according to claim 9, wherein the frame comprises:

a sealer groove that receives the second part of the bearing sealer; and a frame channel that is fluidly connected to the sealer groove, that extends through an outer circumferential surface of the cylinder, and that is configured to supply the refrigerant to the cylinder.

11. The linear compressor according to claim 9, wherein the through-hole provides the passage for the refrigerant that passes through the cover hole, and wherein the through-hole defines a refrigerant channel at the first part and the second part of the bearing sealer.

12. The linear compressor according to claim 11, wherein the refrigerant channel comprises:

a first refrigerant channel that is defined at the first part of the bearing sealer;

a second refrigerant channel that is defined at the second part of the bearing sealer; and a third refrigerant channel that fluidly connects the first refrigerant channel to the second refrigerant channel, the third refrigerant channel comprising (i) a first region that is defined at the first part of the bearing sealer and (ii) a second region that is defined at the second part of the bearing sealer.

13. The linear compressor according to claim 12, wherein the first refrigerant channel has a first inner diameter that is greater than each of an inner diameter of the cover hole and a third inner diameter of the third refrigerant channel, and wherein the second refrigerant channel has a second inner diameter that is greater than the first inner diameter of the first refrigerant channel.

14. The linear compressor according to claim 12, wherein the first part and the second part are disposed eccentrically with respect to the axial direction.

15. The linear compressor according to claim 1, wherein the bearing sealer includes rubber.

16. A linear compressor comprising:

a discharge cover that supports a discharge valve;

a cover housing that receives the discharge cover and that defines a housing chamber;

a frame that is coupled to the cover housing;

a cylinder that is inserted into the frame and that receives a piston, wherein the piston is configured to reciprocate in the cylinder in an axial direction; and a bearing sealer that is disposed at an interface between the frame and the cover housing and that defines a passage for refrigerant, the bearing sealer including:

a first part that is received at the cover housing and defines a first refrigerant channel of the passage, and a second part that is received at the frame and defines a second refrigerant channel of the passage, wherein the first part and the second part are arranged such that a center of the first refrigerant channel in the axial direction is disposed eccentrically with respect to a center of the second refrigerant channel in the axial direction.

17. The linear compressor according to claim 16, wherein the discharge cover comprises a cover hole that is defined at the bearing sealer and that is configured to discharge the refrigerant in the housing chamber.

18. The linear compressor according to claim 17, wherein the discharge cover comprises:

a cover body; and a cover flange that is connected to the cover body and that extends in a radial direction, and wherein the cover hole is defined at the cover flange.

19. The linear compressor according to claim 18, wherein the bearing sealer is disposed to contact the cover flange.

20. The linear compressor according to claim 18, wherein the discharge cover further comprises:

a stepped portion that extends from the cover flange in an axial direction; and a seating portion that extends from the stepped portion in the radial direction and that receives a spring assembly that is coupled to the discharge valve, wherein a first bracket sealing member is disposed between the spring assembly and the seating portion.

21. A linear compressor comprising:

a discharge cover that supports a discharge valve;

a cover housing that receives the discharge cover and that defines a housing chamber;

a frame that is coupled to the cover housing;

a cylinder that is inserted into the frame and that receives a piston, the piston being configured to reciprocate in the cylinder in an axial direction;

a nozzle that is disposed at the cylinder and that is configured to introduce, into the cylinder, refrigerant that is discharged through the discharge valve; and a bearing sealer that is disposed at an interface between the frame and the cover housing and that defines a passage for the refrigerant that is transferred to the nozzle, the bearing sealer comprising (i) a first part that is received at the cover housing and (ii) a second part that is connected to the first part and received at a sealer groove of the frame, wherein the discharge cover comprises a cover hole that is defined at the bearing sealer and that is configured to enable discharge of the refrigerant from the housing chamber, and wherein the frame comprises a frame channel that is fluidly connected to the sealer groove, that extends through an outer circumferential surface of the cylinder, and that is configured to supply the refrigerant to the cylinder.

* * * * *